US008925270B2

(12) United States Patent
Grisolia et al.

(10) Patent No.: US 8,925,270 B2
(45) Date of Patent: Jan. 6, 2015

(54) FOAM WALL STRUCTURE

(71) Applicants: IBACOS, Inc., Pittsburgh, PA (US); Bayer MaterialScience LLC, Pittsburgh, PA (US)

(72) Inventors: Anthony Grisolia, West Leechburg, PA (US); James Leonard Lambach, McMurray, PA (US)

(73) Assignee: Bayer MaterialScience, LLC, Pittsburgh, PA (US)

( * ) Notice: Subject to any disclaimer, the term of this patent is extended or adjusted under 35 U.S.C. 154(b) by 0 days.

(21) Appl. No.: 13/972,573

(22) Filed: Aug. 21, 2013

(65) Prior Publication Data

US 2014/0053486 A1 Feb. 27, 2014

Related U.S. Application Data

(60) Provisional application No. 61/691,422, filed on Aug. 21, 2012.

(51) Int. Cl.

| | |
|---|---|
| ***E04C 1/00*** | (2006.01) |
| ***E04B 2/00*** | (2006.01) |
| ***E04C 2/38*** | (2006.01) |

(52) U.S. Cl.

CPC .. *E04B 2/00* (2013.01); *E04C 2/386* (2013.01)
USPC ..... 52/309.7; 52/309.1; 52/309.4; 52/309.5; 52/309.8

(58) Field of Classification Search

USPC ..... 52/742.1, 742.12, 745.05, 745.09, 52/309.7, 309.1, 309.4, 309.5, 309.8
See application file for complete search history.

(56) References Cited

U.S. PATENT DOCUMENTS

| | | | | |
|---|---|---|---|---|
| 5,353,560 | A * | 10/1994 | Heydon | 52/281 |
| 5,950,386 | A * | 9/1999 | Shipman et al. | 52/481.2 |
| 8,397,387 | B2 * | 3/2013 | Cole et al. | 29/897.34 |
| 8,397,465 | B2 | 3/2013 | Hansbro et al. | |
| 8,458,983 | B2 * | 6/2013 | Propst | 52/741.41 |
| 2004/0016194 | A1 * | 1/2004 | Stefanutti et al. | 52/425 |
| 2010/0011701 | A1 * | 1/2010 | Cole et al. | 52/749.1 |
| 2011/0173911 | A1 * | 7/2011 | Propst | 52/309.13 |
| 2011/0214374 | A1 * | 9/2011 | Propst | 52/309.17 |
| 2012/0011792 | A1 | 1/2012 | DeWildt et al. | |
| 2012/0096785 | A1 * | 4/2012 | Weeks | 52/220.1 |
| 2012/0240501 | A1 * | 9/2012 | Spiegel | 52/309.4 |
| 2013/0104480 | A1 | 5/2013 | Smith | |

* cited by examiner

*Primary Examiner* — Mark Wendell
(74) *Attorney, Agent, or Firm* — The Webb Law Firm

(57) ABSTRACT

A foam wall structure includes a frame, at least one primary support member, and a foam layer. The frame can include: a first member; a second member spaced apart from the first member; and two side members extending between the first and second members. The frame defining a front frame surface and an opposite rear frame surface. The at least one primary support member can be positioned between the two side members and extend between the first and second member. The primary support member defines a front support surface and an opposite rear support surface. The foam layer can be received within at least a portion of the frame and overlies the front surface of the primary support member to form an uninterrupted exposed foam surface. A method of making a foam wall structure is also disclosed.

25 Claims, 9 Drawing Sheets

FOAM WALL STRUCTURE

CROSS REFERENCE TO RELATED APPLICATIONS

This application claims the benefit of U.S. Provisional Application No. 61/691,422, filed Aug. 21, 2012, which is hereby incorporated in its entirety by reference.

BACKGROUND OF THE INVENTION

1. Field of the Invention

The present invention relates generally to wall systems, and, in particular, to a foam wall structure.

2. Description of Related Art

Insulated wall panels provide thermal insulation for residential homes and buildings. A wall panel's R-value is its ability to impede heat flow. The greater the ability to impede heat flow, the higher the R-value. Over the years, insulation standards have become more strict, requiring higher R-values and continuous insulation on the exterior side of insulated wall panels. The current market solutions to these stricter requirements are (1) pre-fabricated wall panels that incorporate insulation at the construction site, and (2) Structural Insulated Panels (SIPs).

The pre-fabricated wall panel that incorporates insulation at the construction site is the more widely adopted solution in the market. However, pre-fabricated wall panels that incorporate high-quality insulation at the construction site require a separate sub-contractor for on-site insulation with fiberglass batting, which is known to have suboptimal R-values. Fiberglass is not an air barrier and allows for air intrusion, thus, increasing the probability of condensation and mold growth within wall systems. Furthermore, additional material is necessary to finish the wall (e.g., Oriented Strand Boards (OSBs) and house wrap), and the overall construction process duration is extended, thereby, increasing possible risk of trade scheduling conflicts. Installing insulation onsite also leads to potential inconsistencies in insulation installation, performance, risk, and usage.

The second solution, SIPs, also have several drawbacks. SIPs typically utilize expanded polystyrene (EPS) foam insulation sandwiched between two OSB boards, which only provide thermal performance of about R-4 per inch. Additionally, current SIPs are mainly used by smaller scale home builders with high levels of home customization.

A need, therefore, exists for an insulated wall structure that satisfies the strict industry insulation requirements and that can be made without excessive material and labor costs.

SUMMARY OF THE INVENTION

According to one embodiment of the present invention, a foam wall structure includes a frame, at least one primary support member, and a foam layer. The frame can include: a first member; a second member spaced apart from the first member; and two side members extending between the first and second members. The first member, second member, and two side members each have a front surface and a rear surface that form the front frame surface and the rear frame surface of the frame. The at least one primary support member can be positioned between the two side members and extend between the first and second member. The primary support member defines a front primary support surface and an opposite rear primary support surface corresponding to the front frame surface and rear frame surface. The foam layer can be received within at least a portion of the frame and overlies the front surface of the primary support member to form an uninterrupted exposed foam surface.

According to another embodiment of the present invention, a method of manufacturing a foam wall structure includes: a) providing a frame with at least one primary support member; b) providing a rigid surface having a width equal to or greater than the width of the front frame surface and length equal to or greater than the length of the front frame surface; c) orientating the front frame surface over the rigid surface such that the front frame surface is substantially parallel to the rigid surface; d) depositing foam material into the frame; and e) allowing the foam material to expand within at least a portion of the frame, wherein the foam layer overlies the front support surface of the primary support member to form an uninterrupted exposed foam surface.

The present invention is also directed to a foam wall structure made according to the methods described herein.

DESCRIPTION OF THE PREFERRED EMBODIMENTS

For purposes of the description hereinafter, spatial orientation terms, if used, shall relate to the referenced embodiment as it is oriented in the accompanying drawing figures or otherwise described in the following description. However, it is to be understood that the embodiments described hereinafter may assume many alternative variations and embodiments. It is also to be understood that the specific devices illustrated in the accompanying figures and described herein are simply exemplary and should not be considered as limiting.

Figure 2:
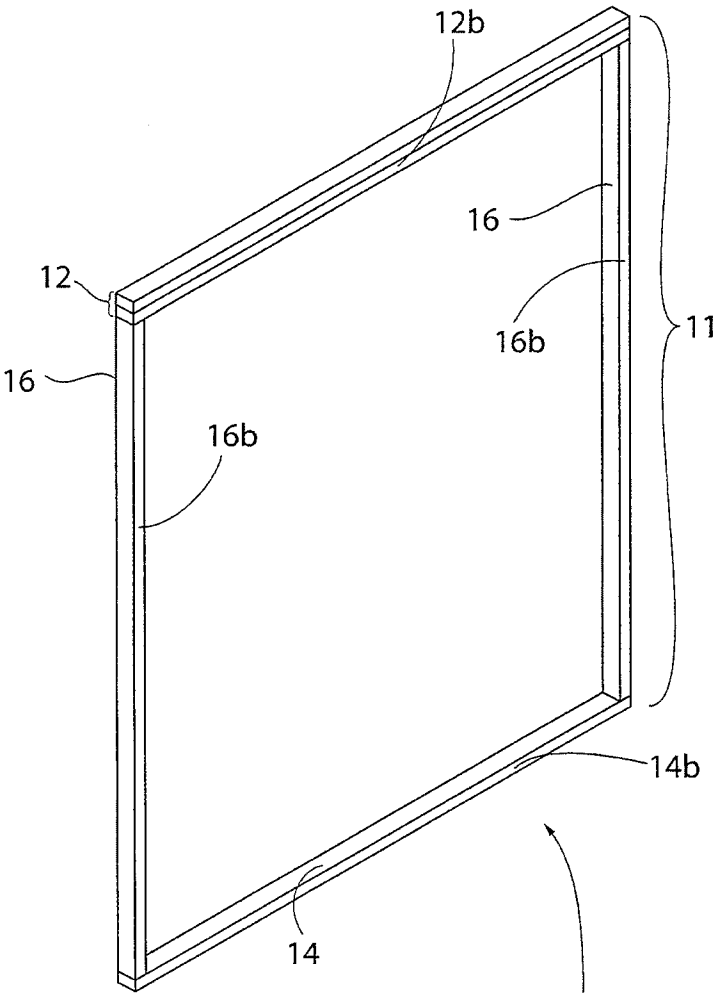
FIG. 2 is a rear perspective view of the frame of FIG. 1 according to one embodiment of the present invention.
Figure 1:
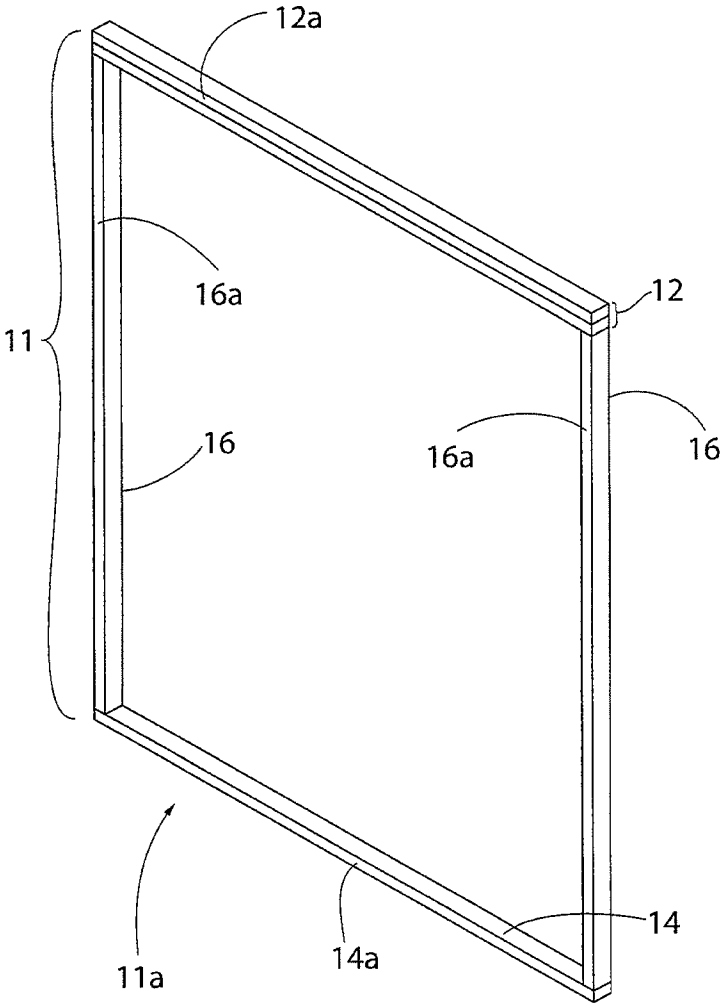
FIG. 1 is a front perspective view of a frame according to one embodiment of the present invention.

As indicated, in certain embodiments, the present invention is directed to a foam wall structure 10 that includes a frame 11, at least one primary support member 17, and a foam layer 30 with an uninterrupted exposed foam surface 31. In certain embodiments, as shown in FIGS. 1-2, the frame 11 may be defined by a first member 12, a second member 14 spaced apart from the first member 12, and two side members 16 extending between the first member 12 and the second member 14. In certain embodiments, the first member 12, second member 14, and two side members 16 each have a front surface 12*a*, 14*a*, 16*a* and a rear surface 12*b*, 14*b*, 16*b* that define a front frame surface 11*a* and a rear frame surface lib, respectively.

The frame 11 can be constructed into different shapes depending on its intended use. In certain embodiments, as shown in FIGS. 1-2, the frame 11 can be constructed as a conventional industry standard rectangular or square frame 11. For example, as shown in FIGS. 1-2, the first member 12 and second member 14 may be spaced apart and extend parallel to each other, and the two side members 16 may extend perpendicular to the first member 12 and second member 14 so as to form a rectangular or square frame 11. The shape and design of the frame 11 is not so limited and can be constructed into any desired shape. Generally, the shape and design of the frame 11 is constructed in accordance with the floor plans designed for a particular home or building.

Figure 4:
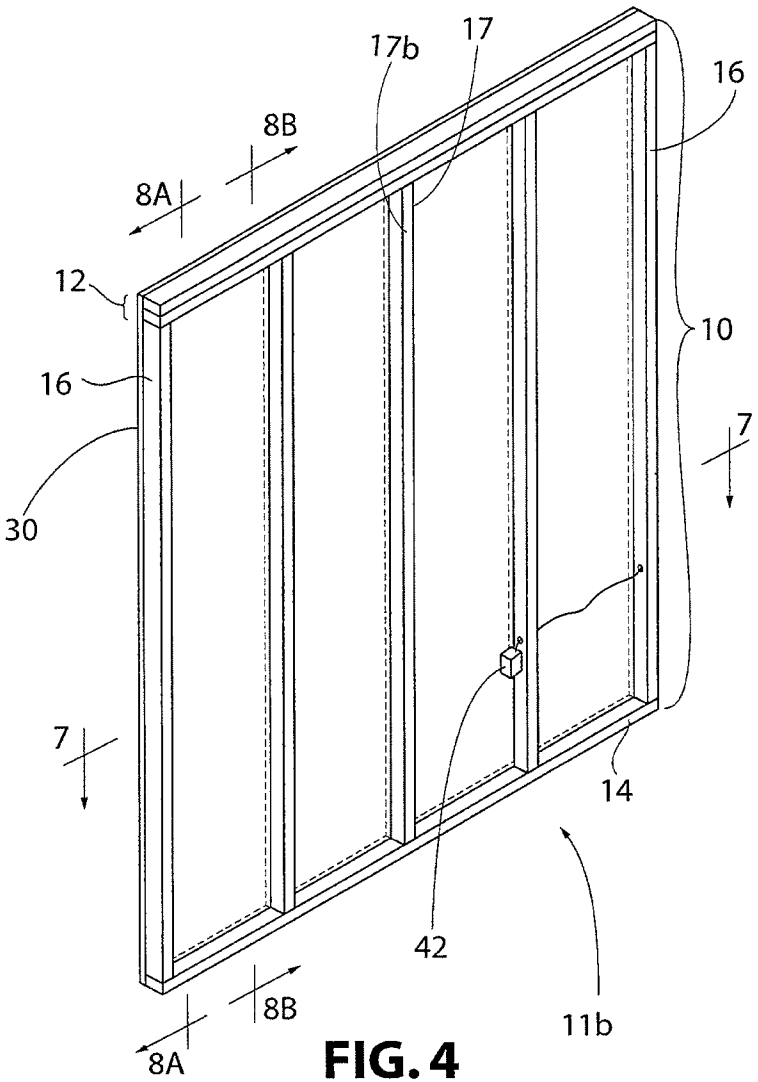
FIG. 4 is rear perspective view of the foam wall structure of FIG. 3 according to one embodiment of the present invention.
Figure 3:
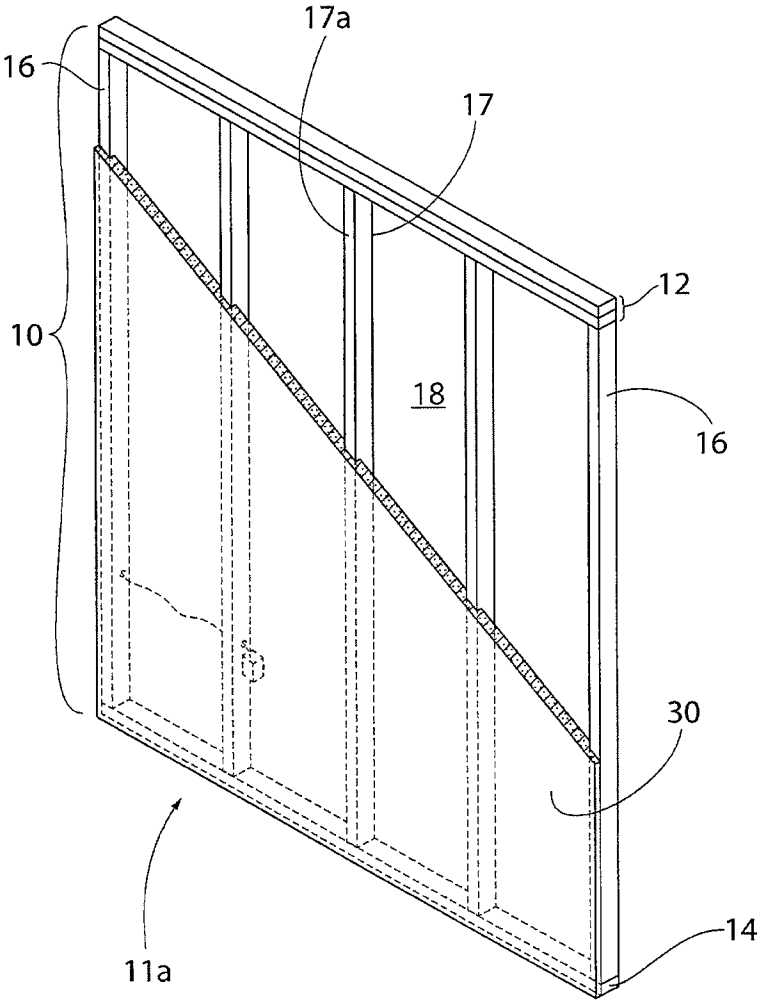
FIG. 3 is a front perspective view of a foam wall structure according to one embodiment of the present invention.

Referring to FIGS. 3-4, in certain embodiments, at least one primary support member 17 may be positioned between the two side members 16. The primary support members 17 may extend between the first member 12 and the second member 14. The primary support members 17 may define a front primary support surface 17*a* and a rear primary support surface 17*b*. As shown in FIGS. 3-4, in certain embodiments, the front primary support surface 17*a* and rear primary support surface 17*b* correspond to the front frame surface 11*a* and rear frame surface 11*b* of the frame 11.

Referring again to FIGS. 3-4, in certain embodiments, the primary support members 17 may be spaced apart to form cavities 18. The cavities 18 may be defined by the area between the primary support members 17, side members 16, first member 12, and/or second member 14. The size of each cavity 18 will vary based on the size of the frame 11, the distance between consecutively positioned primary support members 17, and the number of primary support members 17 present.

Further, the primary support members 17, side members 16, first member 12, and/or second member 14 may comprise one or more plates, boards, beams, or the like. For example, as shown in FIGS. 1-4, the first member 12 may include two plates.

In certain embodiments, the two side members 16 and/or primary support members 17 are fixedly engaged to the first member 12 and second member 14. For instance, in certain embodiments, the two side members 16 and/or primary support members 17 are fixedly engaged to the first member 12 and second member 14 with fasteners. Suitable fasteners that can be used with the present invention include, but are not limited to, nails, staples, bolts, screws, and rivets. The first member 12, second member 14, two side members 16, and primary support members 17 can be made of various materials. For example, the first member 12, second member 14, two side members 16, and primary support members 17 can be made of wood, metal, fiberglass, plastic, or a combination thereof. The first member 12, second member 14, two side members 16, and primary support members 17 can be made of the same material or different materials.

Further, the dimensions of the first member 12, second member 14, two side members 16, and primary support members 17 will vary depending on the intended use of the frame 11. The first member 12, second member 14, two side members 16, and primary support members 17 can each have any dimension. In certain embodiments, the first member 12, second member 14, two side members 16, and primary support members 17 have the same dimensions. For example, the first member 12, second member 14, two side members 16, and primary support members 17 may have the same width and height dimensions. In one non-limiting embodiment, the first member 12, second member 14, two side members 16, and primary support members 17 all have a width and height dimension of nominally 2×4 inches. In another non-limiting embodiment, the first member 12, second member 14, two side members 16, and primary support members 17 all have a width and height dimension of nominally 2×6 inches.

In certain embodiments, the first member 12, second member 14, and two side members 16 have the same dimensions that are different from the dimensions of the primary support members 17. For example, the first member 12, second member 14, and two side members 16 may have the same width and height dimensions, and the primary support members 17 may have width and height dimensions that are different from the first member 12, second member 14, and two side members 16. In one non-limiting embodiment, the first member 12, second member 14, and two side members 16 have a width and height dimension of nominally 2×6 inches, and the primary support members 17 have a width and height dimension of nominally 2×4 inches.

Figure 6:
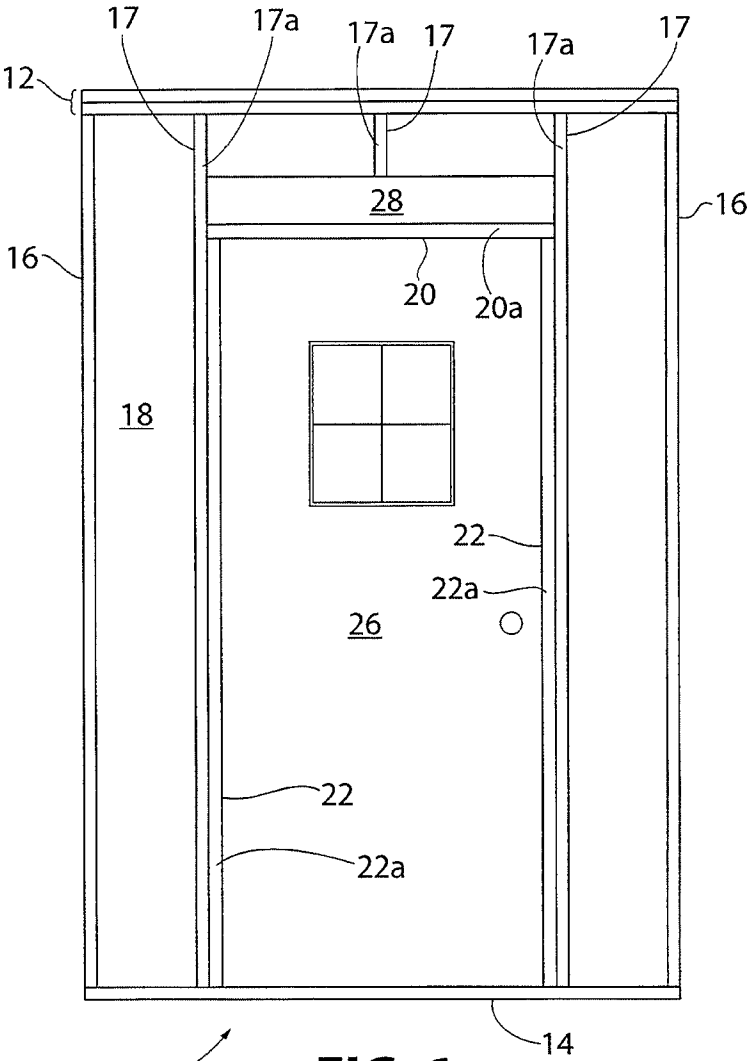
FIG. 6 is a front view of a frame with a door according to one embodiment of the present invention.
Figure 5:
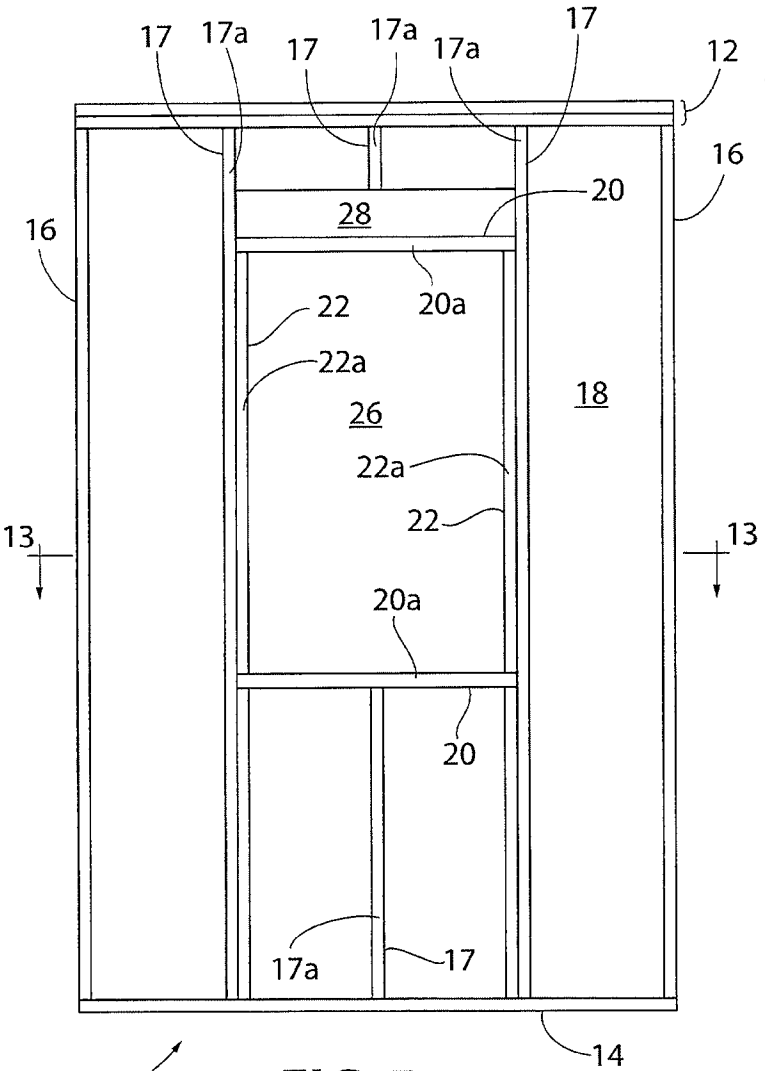
FIG. 5 is a front view of a frame with a window according to one embodiment of the present invention.

In addition to the above, and as shown in FIGS. 5-6, one or more secondary support members 20 and/or tertiary support members 22 may be used. The secondary support members 20 and tertiary support members 22 may comprise one or more plates, boards, beams, or the like. The secondary support members 20 and tertiary support members 22 can be incorporated into the frame 11 to provide structural support to form spaces for windows and doors, and the like. Further, the secondary support members 20 and tertiary support members 22 can have dimensions that are the same or different from the primary support members 17, side members 16, first member 12, and/or second member 14. In one embodiment, the secondary support members 20 and tertiary support members 22 have greater lengths than the primary support members 17, side members 16, first member 12, and/or second member 14.

As shown in FIGS. 5-6, the secondary support members 20 may have a front secondary support surface 20*a* and a rear secondary support surface (not shown) that correspond with the front and rear frame surfaces 11*a*, 11*b* and the front and rear primary support surface 17*a*, 17*b*. Similarly, the tertiary support members 22 may have a front tertiary support surfaces 22*a* and a rear tertiary support surface 22*b* (shown in FIG. 17) that correspond with the front and rear frame surfaces 11*a*, 11*b* and the front and rear primary support surfaces 17*a*, 17*b*.

In certain embodiments, the secondary support members 20 extend between and attach to primary support members 17, or alternatively, the secondary support members 20 extend between and attach to a primary support member 17 and a side member 16. In some embodiments, tertiary support members 22 extend between two secondary support members 20 or between a secondary support member 22 and the first member 12 and/or second member 14.

In certain embodiments, the secondary support members 20, tertiary support members 22, primary support members 17, side members 16, first member 12, and/or second member 14 form a secondary cavity 26. As shown in FIGS. 5-6, the secondary cavity 26 can be used as a space for a window, door, or any other opening. For example, in certain embodiments, the secondary support members 20, tertiary support members 22, primary support members 17, side members 16, first member 12, and second member 14 can be constructed as a conventional industry standard rectangular or square wall panel having a window, door, or any other opening. For example, referring to FIG. 5, a rectangular or square wall panel having a window can be formed as follows: a first member 12 and second member 14 may be spaced apart and extend parallel to each other; two side members 16 may extend between the first member 12 and second member 14 in a direction perpendicular to the first member 12 and second member 14; primary support members 17 may be positioned between the side members 16 and extend between the first member 12 and second member 14 in a direction perpendicular to the first member 12 and second member 14; two secondary support members 20 may be spaced apart and extend between primary support members 17 in a direction parallel to the first member 12 and second member 14; and two tertiary support members 22 may be spaced apart and extend between the two secondary members 20 in a direction perpendicular to the secondary support members 20 and the first member 12 and second member 14. In addition, primary support members 17 can also extend between the secondary members 20 and the first member 12 and/or second member 14. As shown in FIG. 5, a secondary cavity 26 is formed between the secondary support members 20 and tertiary support members 22. The resulting rectangular or square wall panel can be used in a residential home or building. The shape and design is not so limited and can assume any shape and design as desired.

In certain embodiments, additional support members and structural elements may also be used depending on the intended use of the foam wall structure 10. For example, and as shown in FIGS. 5 and 6, a header 28 may be used to provide additional support for a door or window. Other additional support members may be used for structural purposes, design purposes, and the like.

In certain embodiments, a foam material can be deposited into the frame 11. As used herein, the term "foam material" refers to a substance that is formed by trapping pockets of gas in a liquid or solid. In certain embodiments, the foam material is a closed-cell foam. As used herein, "closed-cell foam" refers to foam that contains discrete, non-interconnecting cells. Non-limiting examples of foam material that can be used with the present invention include materials made with polyurethane, polyisocyanurate (also referred to as polyiso), and mixtures thereof.

In some embodiments, the foam material may be substantially free, may be essentially free, and may be completely free of halogen containing flame retardant additives. The term "halogen" refers to the halogen elements, which include fluorine, chlorine, bromine and iodine, and the term "halogen containing flame retardant additives" refers to a substance that may be used to inhibit or resist the spread of fire and which contains halogen groups such as a fluoro, chloro, bromo and/or iodo group. Further, the term "substantially free" as used in this context means the foam material contains less than 1000 parts per million (ppm), "essentially free" means less than 100 ppm, and "completely free" means less than 20 parts per billion (ppb) of halogen containing flame retardant additives.

Figure 7:
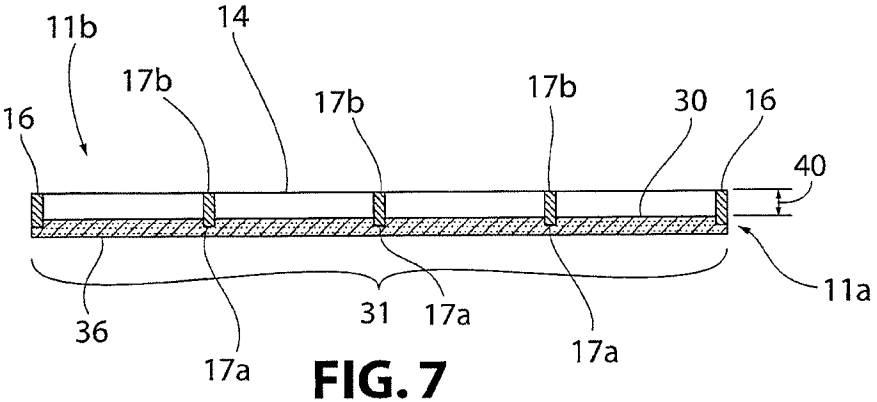
FIG. 7 is a top cross-sectional view of the foam wall structure of FIG. 4 according to one embodiment of the present invention.

As shown in FIGS. 3-4 and 7-8, the foam material can be deposited into the frame 11 such that the foam material forms a foam layer 30 within at least a portion of the frame 11 between the front frame surface 11*a* and the rear frame surface lib. As shown in FIG. 7-8, the foam layer 30 may extend beyond the front primary support surfaces 17*a* such that the foam layer 30 overlies the front support surfaces 17*a* to form a continuous or uninterrupted exposed foam surface 31. As used herein, "continuous or uninterrupted foam layer" refers to a foamed material that is connected or bonded along at least one path without a break or interruption.

Figures 8A, 8B:
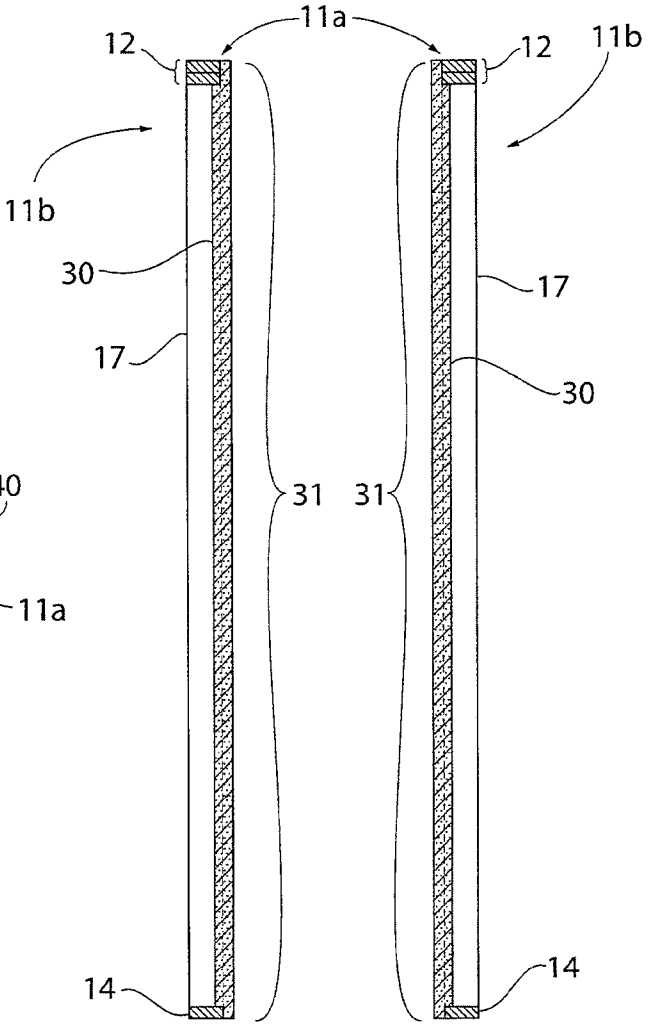
FIG. 8A is a side cross-sectional view of the foam wall structure of FIG. 4 according to one embodiment of the present invention.
FIG. 8B is a side cross-sectional view of the foam wall structure of FIG. 4 according to one embodiment of the present invention.

In certain embodiments, referring to FIGS. 3 and 7-8, the foam layer 30 extends beyond the front primary support surfaces 17*a* and the front frame surface 11*a*. As such, the foam layer 30 forms a continuous or uninterrupted exposed foam surface 31 over the front primary support surfaces 17*a* and the front frame surface 11*a*, which can be seen in the top cross-sectional view of FIG. 7 and the side cross-sectional view of FIGS. 8A and 8B. As shown in FIGS. 7-8, the continuous or uninterrupted exposed foam surface 31 can extend over the entire front frame surface 11*a*.

Figure 9:
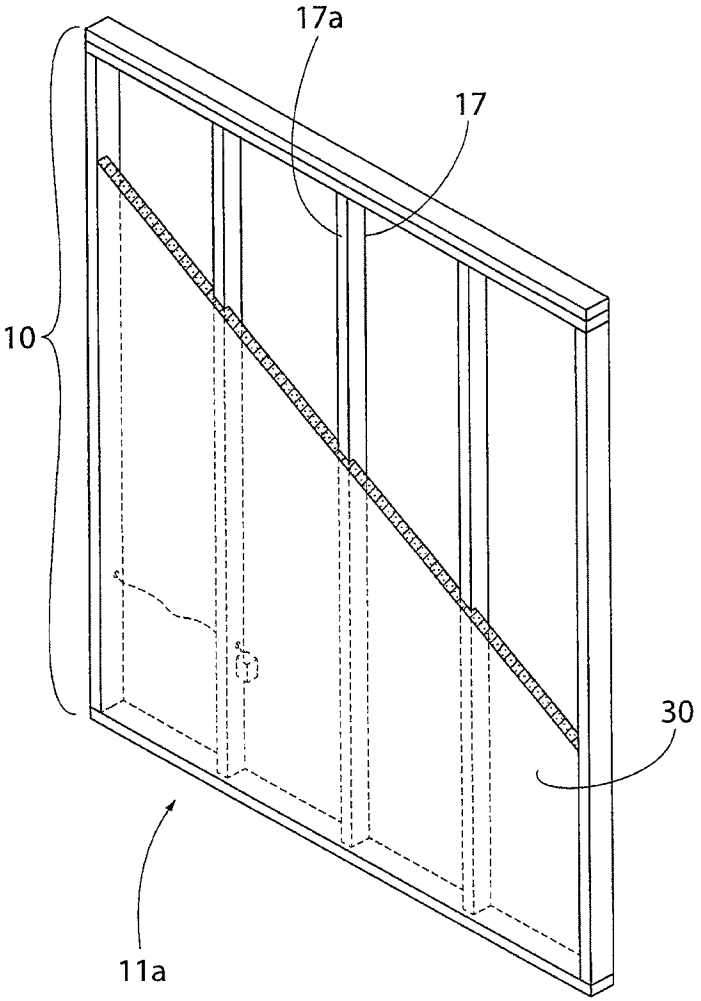
FIG. 9 is a front perspective view of a foam wall structure according to one embodiment of the present invention.
Figures 12A, 12B:
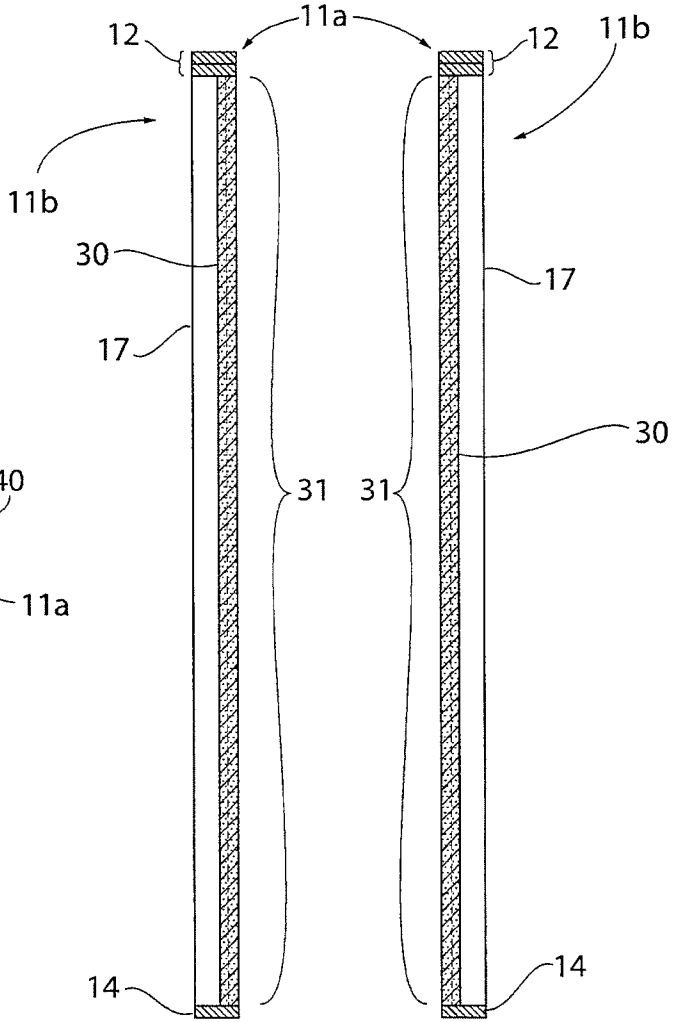
FIG. 12A is a side cross-sectional view of the foam wall structure of FIG. 9 according to one embodiment of the present invention.
FIG. 12B is a side cross-sectional view of the foam wall structure of FIG. 9 according to one embodiment of the present invention.
Figure 11:
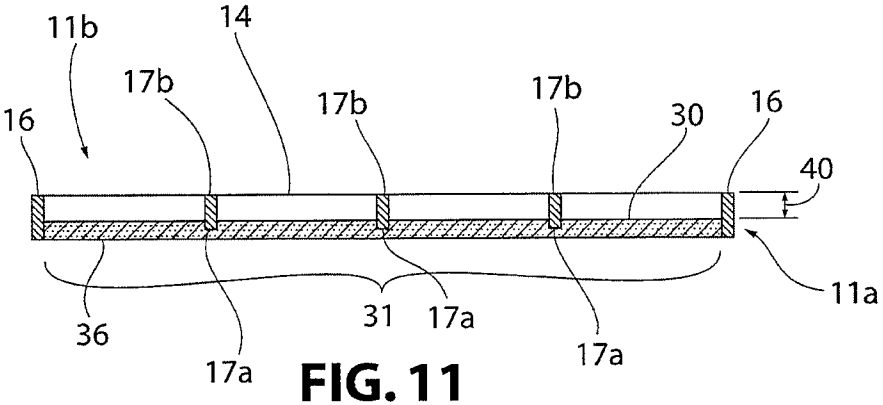
FIG. 11 is a top cross-sectional view of the foam wall structure of FIG. 9 according to one embodiment of the present invention.

Referring to FIGS. 9 and 11-12, in certain embodiments, the foam layer 30 does not extend beyond the front frame surface 11*a*, and only extends beyond the front primary support surfaces 17*a*. Accordingly, in some embodiments, the foam layer 30 forms a continuous or uninterrupted exposed foam surface 31 over the front primary support surfaces 17*a* and is flush or contained between the front and rear frame surfaces 11*a*, 11*b*. As shown in FIGS. 11-12, the continuous or uninterrupted exposed foam surface 31 can overlay all the front primary support surfaces 17*a*.

Figure 10:
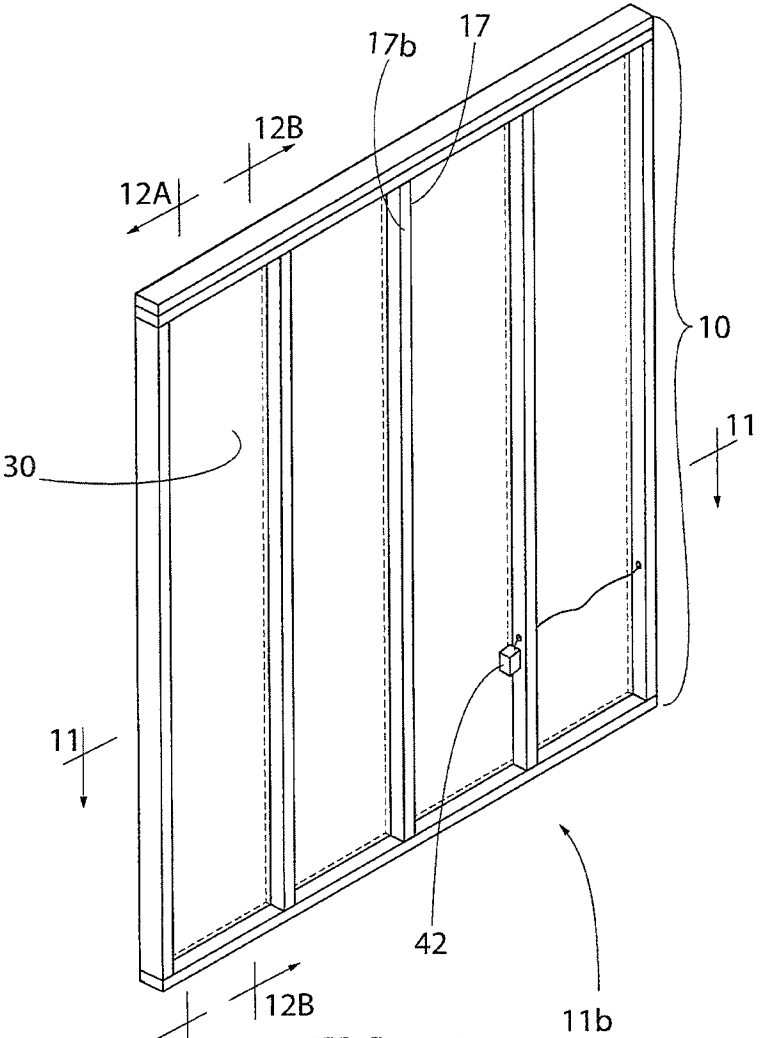
FIG. 10 is a rear perspective view of the foam wall structure of FIG. 9 according to one embodiment of the present invention.

Referring to FIGS. 7 and 11, the foam layer 30 can be dimensioned to expand from the uninterrupted exposed surface 31 to a position intermediate the front frame surface 11*a* and rear frame surface 11*b*, thereby forming a gap or opening 40 within the foam wall structure 10 between the foam layer 30 and the rear frame surface 11*b*. FIGS. 4 and 10 further show that this gap 40 can be used as an area to incorporate home utility components 42 such as electrical wires, cords, heating and cooling pipes, and plumbing fixtures. These home utility components 42 may be inserted into the gap 40 located between the foam layer 30 and the rear frame surface 11*b* such that utility components 42 are not surrounded or contacting the foam layer 30. In certain embodiments, the gap 40 comprises at least two inches as measured between the foam layer 30 and the rear frame surface 11*b*.

Figure 13:
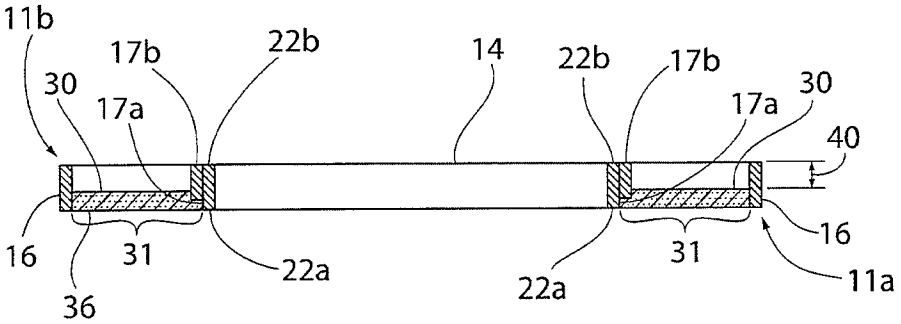
FIG. 13 is a top cross-sectional view of a foam wall structure according to one embodiment of the present invention.

In certain embodiments, when secondary support members 20 and/or tertiary support members 22 are used with the foam wall structure 10 to form a secondary cavity 26, the secondary cavity 26 can be free of foam. For example, in some embodiments, the foam layer 30 does not extend beyond and over the front secondary support surfaces 20*a* of the secondary members 20, the front tertiary support surfaces 22*a* of the tertiary support members 22, and/or beyond and over at least a portion of the front surfaces of other members that help form the secondary cavity 26. FIG. 13 shows a top cross-sectional view with the foam layer 30 not extending beyond the front tertiary support surfaces 22*a* according to one embodiment.

Further, the foam layer 30 can be formed in-situ during the manufacturing process. The term "formed in-situ during the manufacturing process" refers to the formation of a foam layer 30 with an uninterrupted exposed foam surface 31 as described herein during manufacturing of the foam wall structure 10 off-site at a facility remote or away from a building construction site. As such, the foam layer 30 with an uninterrupted exposed foam surface 31 may not be formed at a construction site as is required by conventional methods.

The foam layer 30 having a continuous or uninterrupted exposed foam surface 31 is able to fill tight spaces and seal gaps that are not visible to the naked eye. The foam layer 30 with an uninterrupted exposed foam surface 31 also acts as a vapor and thermal insulating barrier, which reduces energy consumption in buildings and residential homes when the present invention is used as a wall panel. In addition, the foam layer 30 with an uninterrupted exposed foam surface 31 provides structural stability to the foam wall structure 10 such as improved wall racking strength. As used herein, "wall racking strength" refers to the ability of a wall structure to maintain its shape under duress.

Referring to FIGS. 7 and 11, in certain embodiments, the continuous or uninterrupted exposed foam surface 31 may include a coating 36 adhered to at least a portion of the exposed foam surface 31. As used herein, the term "coating" includes a partial or continuous film or layer that can be applied to a surface. Non-limiting examples of coatings 36 that can be adhered or attached to the exposed foam surface 31 includes coatings 36 that provide protection from ultraviolet (UV) radiation, weathering, or a combination thereof. The coating 36 can also provide stability to the exposed foam surface 31. For example, the coating 36 may include fibrous materials such as, but not limited to, glass fibers.

Further, in certain embodiments, the foam wall structure 10 does not include a rigid sheathing layer. As used herein, the term "rigid sheathing layer" refers to a layer applied to at least a portion of the front frame surface 11*a* or rear frame surface 11*b*. Non-limiting of sheathing layers include boards, plates, and the like. For instance, the foam wall structure does not include foam boards, wood boards, metal boards, gypsum boards, paper boards, polymeric foam boards, plates, and the like. Examples of such sheathing layers are disclosed in U.S. Pat. No. 8,397,465 and U.S. Patent Application Publication No. 2012/0011792. The foam wall structure 10, excluding such materials according to the present invention, is able to flex or deform under a load and return to its original design while retaining its structural stability, racking strength, and other physical characteristics.

The present invention is also directed to methods of making a foam wall structure 10. In certain embodiments, a method of making a foam wall structure 10 includes first constructing a frame 11 having at least one primary support member 17. The frame 11 having at least one primary support member 17 can be constructed in accordance with any of the embodiments disclosed herein. Referring to FIGS. 14-17, after constructing the frame 11 with at least one primary support member 17, the front frame surface 17*a* can be orientated over a rigid surface 50 such that the front frame surface 11*a* is positioned parallel or at least substantially parallel to the rigid surface 50. A "rigid surface" refers to any surface that is capable of receiving the frame 11 without bending, flexing, or moving. In certain embodiments, and as shown in FIGS. 14-17, the rigid surface 50 has a width equal to or greater than the width of the front frame surface 11*a* and a length equal to or greater than the length of the front frame surface 11*a*. In one non-limiting example, the rigid surface 50 is substantially horizontal.

After orientating the front frame surface 17*a* over the rigid surface 50, a foam material can be deposited into the frame 11. The foam material may be deposited with an automated delivery device. Alternatively, the foam may be deposited using various other devices including, but not limited to, a foam dispensing gun that is controlled and carried by an individual user. In one embodiment, as shown in FIGS. 14-17, the foam material is deposited with an automated foam dispensing rig 60 that can be calibrated to dispense a pre-determined amount of foam. The foam dispensing rig 60 can include one or more nozzles 62. The nozzles 62 can be positioned over the frame 11 of the foam wall structure 10 so that each nozzle 62 sprays or pours foam into cavities 18 located within the frame 11 such as the cavities 18 shown in FIG. 3. A foam dispensing rig 60 with a plurality of nozzles 62 makes it possible to dispense foam quickly and efficiently. In certain embodiments, the nozzles 62 can move into different positions.

Figure 14:
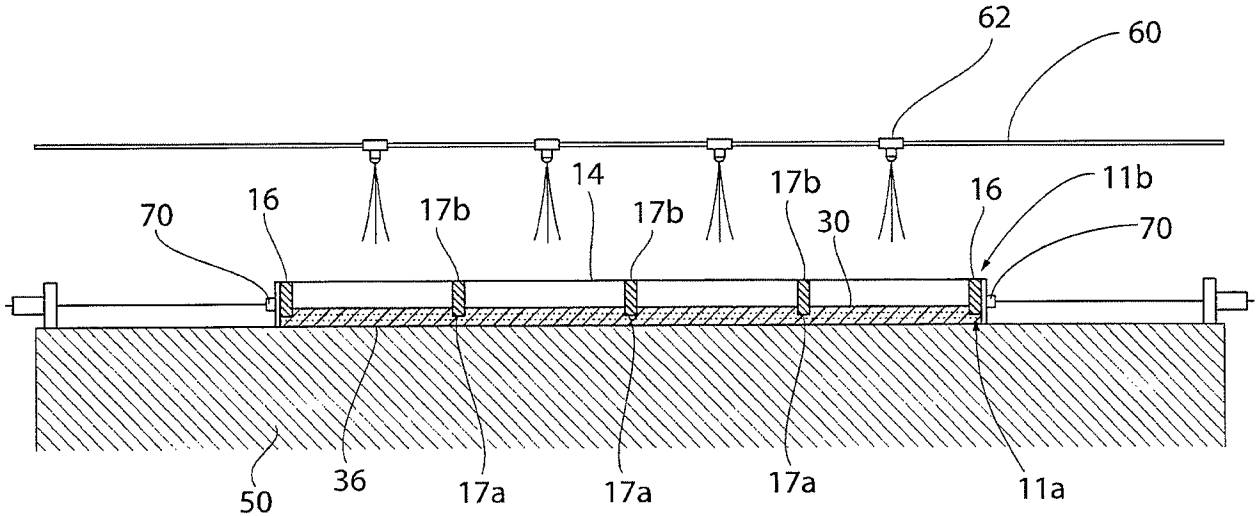
FIG. 14 is a top cross-sectional view of foam material being deposited into a frame according to one embodiment of the present invention.

Referring to FIGS. 14-17, in certain embodiments, the foam material may be deposited so that the foam material contacts the rigid surface 50. As shown in FIG. 14, the material may be deposited so that a foam layer 30 extends beyond the front primary support surfaces 17*a* and the front frame surface 11*a*. As such, the foam layer 30 forms a continuous or uninterrupted exposed foam surface 31 over the front primary support surfaces 17*a* and the front frame surface 11*a*.

Figure 16:
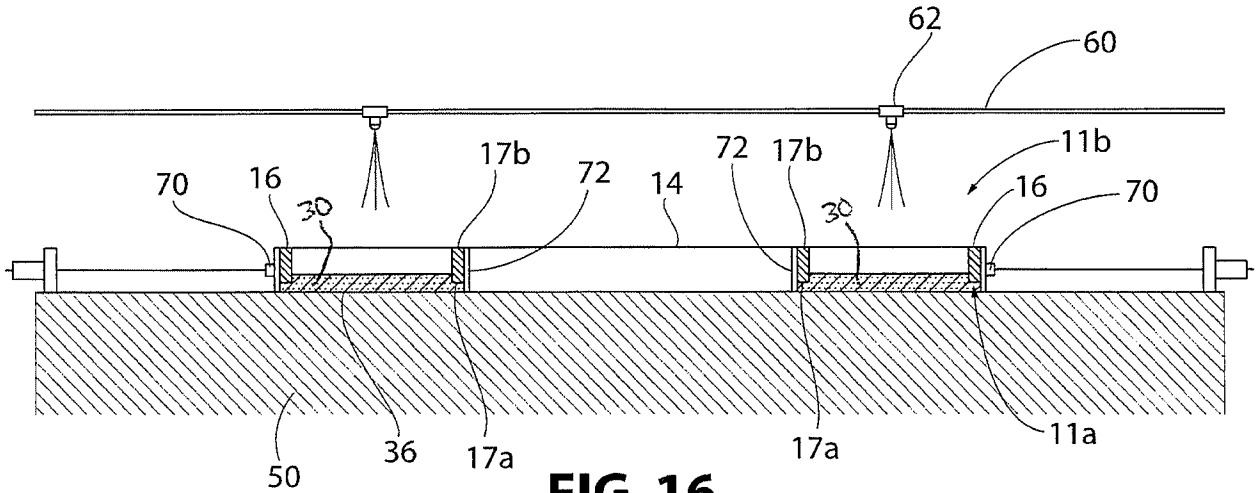
FIG. 16 is a top cross-sectional view of foam material being deposited into a frame according to one embodiment of the present invention.

Referring to FIG. 16, in certain embodiments, the foam material is deposited so that the foam layer 30 does not extend beyond the front frame surface 11*a*. Accordingly, in some embodiments, the foam material is deposited so that a foam layer 30 forms a continuous or uninterrupted exposed foam surface 31 over the front primary support surfaces 17*a* and is flush or contained between the front frame surface 11*a* and rear frame surface 11*b*.

Figure 15:
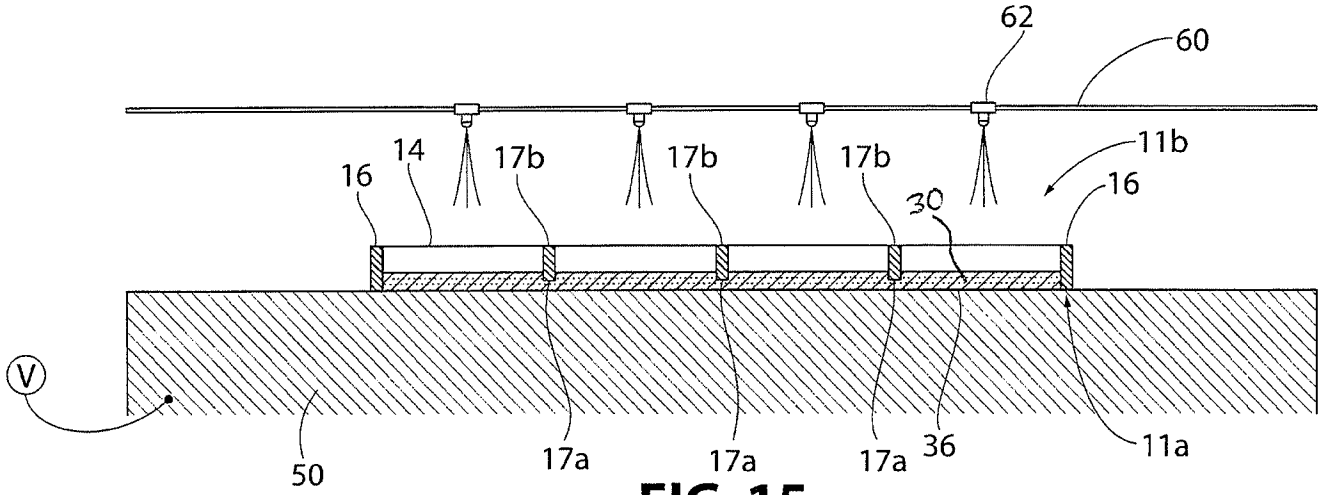
FIG. 15 is a top cross-sectional view of foam material being deposited into a frame according to one embodiment of the present invention.

As shown in FIGS. 15-16, the foam material can be deposited so that the foam layer 30 can expand from the uninterrupted exposed surface 31 to a position intermediate the front frame surface 11*a* and rear frame surface 11*b*. A gap or opening 40 can therefore be formed between the foam layer 30 and the rear frame surface 11*b* to incorporate home utility components 42 such as electrical wires, cords, heating and cooling pipes, and plumbing fixtures, as can be seen in FIGS. 4 and 10.

Referring to FIG. 14, the front frame surface 11*a* can be moved away from or elevated to a position above the rigid surface 50. The front frame surface 11*a* can be elevated above the rigid surface 50 using an elevation device including, but not limited to, an industrial panel raiser. In operation, the elevation device holds the front frame surface 11*a* securely in place at a specified distance above the rigid surface 50. The higher it is elevated above the surface, the farther the foam layer 30 will extend beyond and over the front primary support surfaces 17*a* and/or the front frame surface 11*a*. Alternatively, in some embodiments, the front frame surface 11*a* can be placed onto the rigid surface 50, as shown in FIG. 15.

As shown in FIGS. 14 and 16, a form 70 can be used to prevent foam material from extending out from the outside perimeter of the frame 11. As used herein, a "form" refers to a barrier that prevents foam or other materials from expanding outside the perimeter of the frame 11. The form 70 may be positioned around the outside perimeter of the frame 11. As shown in FIG. 16, a second form 72 may be positioned between adjacent primary support members 17 to prevent foam material 30 from expanding into undesired areas.

Referring to FIG. 14, in one non-limiting embodiment, the front frame surface 11*a* can be elevated above a rigid surface 50 and foam material can be deposited such that a foam layer 30 is formed with an uninterrupted exposed surface 31 over the front primary support surfaces 17*a* and the front frame surface 11*a*. The foam material can be deposited so that the foam layer 30 can expand from the uninterrupted exposed surface 31 to a position intermediate the front frame surface 11*a* and rear frame surface lib. A form 70 can be placed around the perimeter of the frame 11 to prevent foam material from expanding outside the perimeter of the frame 11.

As shown in FIG. 15, in another non-limiting embodiment, the front frame surface 11*a* can be placed onto the rigid surface 50. As shown in FIG. 15, foam material can be deposited such that a foam layer 30 is formed with an uninterrupted exposed surface 31 extending over the front primary support surfaces 17*a* and not the front frame surface 11*a*. As such, the foam layer 30 forms a continuous or uninterrupted exposed foam surface 31 over the front primary support surfaces 17*a* and is flush or contained between the front and rear frame surface 11*a*, 11*b*.

Figure 17:
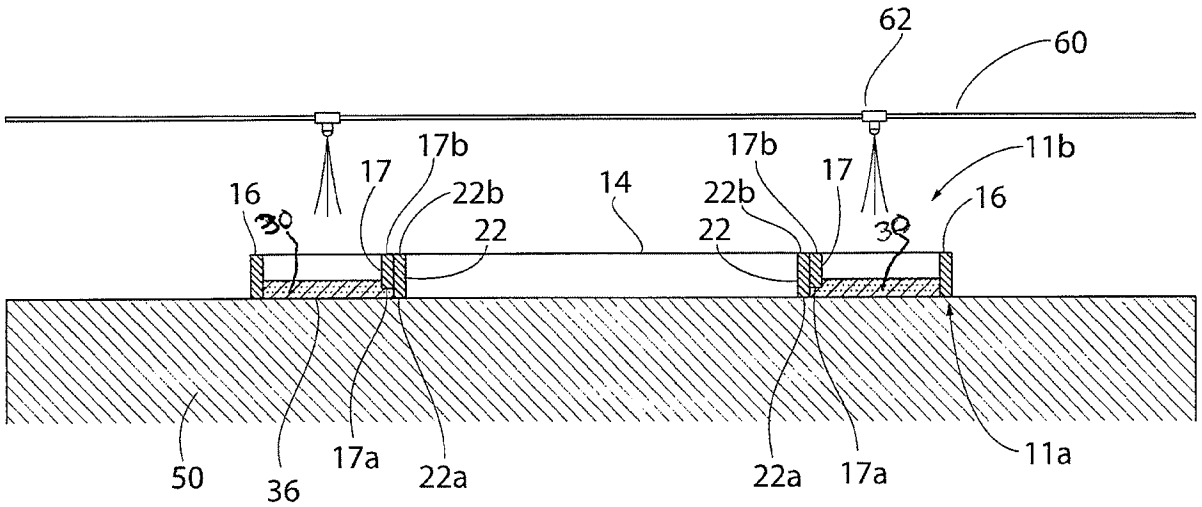
FIG. 17 is a top cross-sectional view of foam material being deposited into a frame according to one embodiment of the present invention.

As indicated, the foam wall structure 10 can also include secondary support members 20 and tertiary support members 22 that form a secondary cavity 26 within the frame 11. Accordingly, in certain embodiments, the methods described herein include constructing a frame 11 having one or more secondary support members 20 and tertiary support members 22. In certain embodiments, to prevent foam material from entering the secondary cavity 26, the dimensions of the secondary support members 20 and/or tertiary support members 22 are greater than the dimensions of the primary support members 17. FIG. 17 shows a top cross-sectional view of the process of depositing foam into a frame 11 with tertiary support members 22 having a greater height than the primary support members 17.

Referring to FIG. 14-17, in certain embodiments, a coating 36 is deposited onto at least a portion of the rigid surface 50. The coating 36 can be deposited to provide protection from ultraviolet (UV) radiation, weathering, friction, contamination, or a combination thereof. The coating 36 can also provide stability to the uninterrupted exposed foam surface 31. For example, the coating may include fibrous materials such as, but not limited to, glass fibers. The coating 36 can also be applied as a release coat that can include, for example, a wax material. The release coat allows the uninterrupted exposed foam surface 31 to separate from the rigid surface 50.

In certain embodiments, the coating 36 deposited onto at least a portion of the rigid surface 50 forms a film. To keep the film aligned along the rigid surface 50, the rigid surface 50 can include perforations, holes and the like where pressure can be lowered so as to pull the film against the rigid surface 50. In one embodiment, the rigid surface 50 is connected to a vacuum source V such as a vacuum table as shown in FIG. 15.

After the foam layer 30 has expanded, the formed foam wall structure 10 can be removed from the rigid surface 50 and shipped directly to a job site for use as a wall panel. The foam wall structure 10 can be installed without any additional steps, thereby reducing the number of sub-contractors necessary to complete the installation of a wall at a construction site. In addition, the foam wall structure 10 does not require additional materials such as rigid sheathing, OSB boards, and house wrap that are typically used in current residential building practices. Therefore, insulation costs would decrease. The present invention would also decrease the overall cost per square foot per R-value.

The foam wall structure 10 also imparts a higher wall racking strength and improves thermal performance in comparison to existing wall solutions through the introduction of a foam layer 30 with the uninterrupted foam surface 31. Further, the foam wall structure 10 will help meet future R-value industry standards that are expected to increase in certain regions, while still utilizing current wall designs. With current fiberglass insulation, builders would have to convert 2×4-based wall designs to 2×6-based wall designs to ensure enough wall cavity capacity for additional insulation to meet such higher standards.

The methods described herein also improve the consistency of installing insulation, and make it easy to install electrical and plumbing components in the gap or opening 40 of a wall panel. The present invention would also decrease the overall cost per square foot per R-value.

The foam wall structure 10 is not limited for use in newly constructed homes and can be used for residential exterior insulation retrofit applications. Accordingly, another aspect of the present invention is the replacement of wall panels in older homes and buildings with the foam wall structure 10 described herein.

While several embodiments of the invention were described in the foregoing detailed description, those skilled in the art may make modifications and alterations to these embodiments without departing from the scope and spirit of the invention. Accordingly, the foregoing description is intended to be illustrative rather than restrictive.

The invention claimed is:

1. A foam wall structure comprising:

a) a frame comprising:

a first member;

a second member spaced apart from the first member; and two side members extending between the first and second members, wherein the first member, second member, and two side members each have a front surface and a rear surface that form the front frame surface and the rear frame surface of the frame;

b) at least one primary support member positioned between the two side members and extending between the first and second member, wherein the primary support member defines a front primary support surface and an opposite rear primary support surface corresponding to the front frame surface and rear frame surface; and c) a foam layer bounded by the first, second, and two side members of the frame, wherein the foam layer overlies the front support surface of the primary support member to form a uniform and continuous exposed foam surface, wherein the foam layer does not overlie the front frame surface such that the foam layer is flush with the front frame surface while overlying the front support surface of the primary support member, and wherein the foam layer is dimensioned to extend from the uniform and continuous exposed foam surface to a position intermediate the front frame surface and rear frame surface such that a gap is formed within the frame between the foam layer and the rear frame surface, the gap extends the distance between the two side members.

2. The foam wall structure of claim 1, wherein the foam wall structure is free of a rigid sheathing layer.

3. The foam wall structure of claim 1, further comprising a coating adhered to at least a portion of the uniform and continuous exposed surface of the foam layer.

4. The foam wall structure of claim 3, wherein the coating provides protection from ultraviolet radiation, weathering, friction, contamination, or a combination thereof.

5. The foam wall structure of claim 1, wherein the first member comprises two plates.

6. The foam wall structure of claim 1, wherein the frame further comprises one or more secondary support members extending between two adjacent primary support members or a primary support member and a side member such that a secondary opening is formed within the frame.

7. The foam wall structure of claim 6, wherein the secondary opening is free of foam.

8. The foam wall structure of claim 6, wherein the frame further comprises one or more tertiary support members extending between two secondary support members, or between a secondary support member and the first member or the second member.

9. The foam wall structure of claim 1, wherein the foam layer is formed in-situ during the manufacturing process.

10. The foam wall structure of claim 9, wherein the foam layer comprises polyurethane, polyisocyanurate, or mixtures thereof.

11. The foam wall structure of claim 1, wherein the foam layer is substantially free of halogen containing flame retardant additives.

12. The foam wall structure of claim 1, wherein the foam layer is completely free of halogen containing flame retardant additives.

13. A method of manufacturing a foam wall structure comprising:

a) providing a frame with at least one primary support member comprising:
   i) a first member;
   ii) a second member spaced apart from the first member;
   iii) two side members extending between the first and second members, the frame defining a front frame surface and an opposite rear frame surface, wherein the first member, second member, and two side members each have a front surface and a rear surface that form the front frame surface and the rear frame surface of the frame; and
   iv) at least one primary support member positioned between the two side members and extending between the first and second member, wherein the primary support member defines a front primary support surface and an opposite rear primary support surface corresponding to the front frame surface and rear frame surface;

b) providing a rigid surface having a width equal to or greater than the width of the front frame surface and length equal to or greater than the length of the front frame surface;

c) orientating the front frame surface over the rigid surface such that the front frame surface is substantially parallel to the rigid surface;

d) depositing foam material into the frame; and e) allowing the foam material to expand within at least a portion of the frame, wherein the foam material forms a foam layer that overlies the front support surface of the primary support member to form a uniform and continuous exposed foam surface, wherein the foam layer extends from the uniform and continuous exposed foam surface to a position intermediate the front frame surface and rear frame surface such that a gap is formed within the frame between the foam layer and the rear frame surface.

14. The method according to claim 13, further comprising elevating the front frame surface above the rigid surface before depositing the foam material into the frame.

15. The method according to claim 13, further comprising placing the front frame surface onto the rigid surface such that the front frame surface contacts the rigid surface.

16. The method according to claim 13, further comprising depositing a coating over at least a portion of the rigid surface, wherein the coating provides protection from ultraviolet radiation, weathering, friction, contamination, or a combination thereof.

17. The method according to claim 13, wherein the rigid surface further comprises a vacuum table.

18. The method according to claim 13, wherein a form is positioned around an outside perimeter of the front frame surface.

19. The method according to claim 13, wherein a form is positioned between adjacent primary support members.

20. The method according to claim 13, wherein the foam material is deposited by an automated dispensing device.

21. The method according to claim 14, wherein the foam layer overlies the front frame surface.

22. The method according to claim 13, wherein the foam layer does not overlie the front frame surface.

23. The method according to claim 13, wherein the foam wall structure is free of a rigid sheathing layer.

24. The method according to claim 13, wherein the foam layer is formed in-situ during the manufacturing process.

25. A foam wall structure comprising:

a) a frame comprising:
   a first member;
   a second member spaced apart from the first member; and
   two side members extending between the first and second members, wherein the first member, second member, and two side members each have a front surface and a rear surface that form the front frame surface and the rear frame surface of the frame;

b) at least one primary support member positioned between the two side members and extending between the first and second member, wherein the primary support member defines a front primary support surface and an opposite rear primary support surface corresponding to the front frame surface and rear frame surface; and c) a foam layer bounded by the first, second, and two side members of the frame, wherein the foam layer overlies the front support surface of the primary support member to form a uniform and continuous exposed foam surface, wherein the foam layer does not overlie the front frame surface such that the foam layer is flush with the front frame surface while overlying the front support surface of the primary support member, and wherein the foam wall structure is free of a rigid sheathing layer.

* * * * *